US008365487B2

(12) United States Patent
Krusec et al.

(10) Patent No.: US 8,365,487 B2
(45) Date of Patent: Feb. 5, 2013

(54) ROOF SUMP STRUCTURE

(75) Inventors: Edward R. Krusec, Grand Rapids, MI (US); James Whitton, Scarborough, ME (US)

(73) Assignee: Hunter Panels LLC, Portland, ME (US)

( * ) Notice: Subject to any disclaimer, the term of this patent is extended or adjusted under 35 U.S.C. 154(b) by 281 days.

(21) Appl. No.: 12/952,269

(22) Filed: Nov. 23, 2010

(65) Prior Publication Data

US 2012/0125450 A1 May 24, 2012

(51) Int. Cl.
*E04D 13/04* (2006.01)
*E04D 13/16* (2006.01)

(52) U.S. Cl. ..... 52/302.3; 52/11; 52/14; 52/90.2; 52/220.1; 52/309.4; 52/302.5; 52/302.6

(58) Field of Classification Search ..... 52/11, 13, 52/15, 90.1, 68–71, 645, 220.5, 220.3, 198, 52/DIG. 10, 309.4, 309.1, 302.1, 302.7; 525/220.8; 137/357, 362, 371, 343; 210/163
See application file for complete search history.

(56) References Cited

U.S. PATENT DOCUMENTS

| | | | | | |
|---|---|---|---|---|---|
| 3,242,573 | A | | 3/1966 | Noel | |
| 3,601,936 | A | | 8/1971 | Schmidt | |
| 3,854,746 | A | * | 12/1974 | Flynn et al. | 280/19.1 |
| 4,014,145 | A | | 3/1977 | Groves | |
| 4,064,662 | A | | 12/1977 | O'Toole | |
| 4,248,357 | A | * | 2/1981 | Stafford | 220/219 |
| 4,503,644 | A | | 3/1985 | Coutu, Sr. | |
| 4,527,362 | A | | 7/1985 | Tobey et al. | |
| 4,530,193 | A | | 7/1985 | Ochs | |
| 4,559,253 | A | * | 12/1985 | Thallinger | 428/64.1 |
| 4,642,950 | A | | 2/1987 | Kelly | |
| 4,719,723 | A | | 1/1988 | Van Wagoner | |
| 5,140,789 | A | | 8/1992 | De Gooyer | |
| 5,144,782 | A | | 9/1992 | Paquette et al. | |
| 5,222,337 | A | | 6/1993 | Thomsen et al. | |
| 5,373,669 | A | | 12/1994 | Paquette | |
| 5,415,570 | A | * | 5/1995 | Sarkissian | 439/676 |
| 5,663,882 | A | | 9/1997 | Douglas | |
| 5,966,883 | A | | 10/1999 | Krusec et al. | |
| 5,966,993 | A | * | 10/1999 | Ekins | 74/502.2 |
| 6,058,659 | A | | 5/2000 | Astrom | |
| 6,088,984 | A | | 7/2000 | Kirby | |
| 6,105,324 | A | * | 8/2000 | Krusec et al. | 52/302.1 |
| 6,155,015 | A | | 12/2000 | Kirby | |
| 6,185,889 | B1 | | 2/2001 | Gilgan et al. | |
| 6,415,570 | B1 | | 7/2002 | Wentz | |
| 6,568,140 | B2 | | 5/2003 | Kirby | |
| 6,622,750 | B1 | | 9/2003 | Bergeron | |
| 6,647,565 | B2 | * | 11/2003 | Smale | 4/613 |
| 7,614,198 | B1 | * | 11/2009 | Piskula et al. | 52/741.1 |

(Continued)

*Primary Examiner* — Jeanette E. Chapman
(74) *Attorney, Agent, or Firm* — Wood, Herron & Evans, LLP

(57) ABSTRACT

A preformed hinged foam sump for use on a flat roof includes two mirror image sides connected along the hinge which folds from an 8×8 structure to a 4×8 structure. Each of the mirror image panels includes a central panel which is a right isosceles triangle which slopes to the 90 degree angle of the right isosceles triangles. Each side includes two side panels which are sloped to the same point as the central panel and are also right isosceles triangles. The panels are bonded together to form each side which is connected by a flexible material or tape along the bottom side to allow the two sides to fold relative to each other to change from an 8×8 structure to a 4×8 structure and open up to an 8×8 structure for use on a roof surface.

6 Claims, 5 Drawing Sheets

U.S. PATENT DOCUMENTS

2006/0101777 A1* 5/2006 Lapointe ..... 52/734.2
2007/0261299 A1 11/2007 Kephart
2009/0019711 A2* 1/2009 Milka ..... 33/1 G
2009/0277113 A1* 11/2009 Taraba et al. ..... 52/302.1

* cited by examiner

ROOF SUMP STRUCTURE

BACKGROUND OF THE INVENTION

Commercial buildings frequently have what are referred to as flat roofs. Such flat roofs must have a slight pitch in order to direct water to a drain. The drain may be at the edge of the building or a corner, or can be in a central portion of the roof in which case there must be a depressed area or sump where the drain is located to encourage water to flow towards the drain. Typically, foam insulation is used to provide the slope. Panels of foam insulation can be formed with a thick edge and a thin edge. These are generally 4×8 sheets of polyisocyanurate foam. These can be purchased having the desired slope. The sump is then formed by cutting individual sheets at the job site to desired size and position around the drain. The waterproof membrane is applied over this and flashing provided at the drain to insure there is no leakage.

This is relatively time consuming. It requires a relatively skilled worker to cut the foam and it also causes a lot of waste at the job site. This makes it difficult to recycle wasted material or to use it for any other purpose. These sumps can be relatively large, i.e., generally 8×8 sections. Typically, roofing materials are 4×8 in size for shipping purposes.

SUMMARY OF THE INVENTION

The present invention is premised on the realization that a preformed sump for a flat roof can be formed with a hinge to allow two mirror imaged sides to fold together along the flat edge and be easily shipped to the job location. More particularly, the sump of the present invention includes two mirror image sides, each side having three panels. Each side includes a large central panel in the form of an isosceles triangle with the right angle of the triangle at a center of the sump, along with two smaller side panels also in the form of isosceles triangles. The hypotenuse of the two side panels lies along the legs of the central panel, all sloping towards the center of one edge. The two sides are bonded together with a flexible tape to form a unitary sump that can simply be unfolded and located in position. While the sump is still folded, the center hole is cut out, providing a passage for the drain pipe. The sump is then placed over the drain pipe and the roof covering is installed per standard specifications.

The objects and advantages of the present invention will be further appreciated in light of the following detailed description and drawings in which:

DETAILED DESCRIPTION

Figure 1:
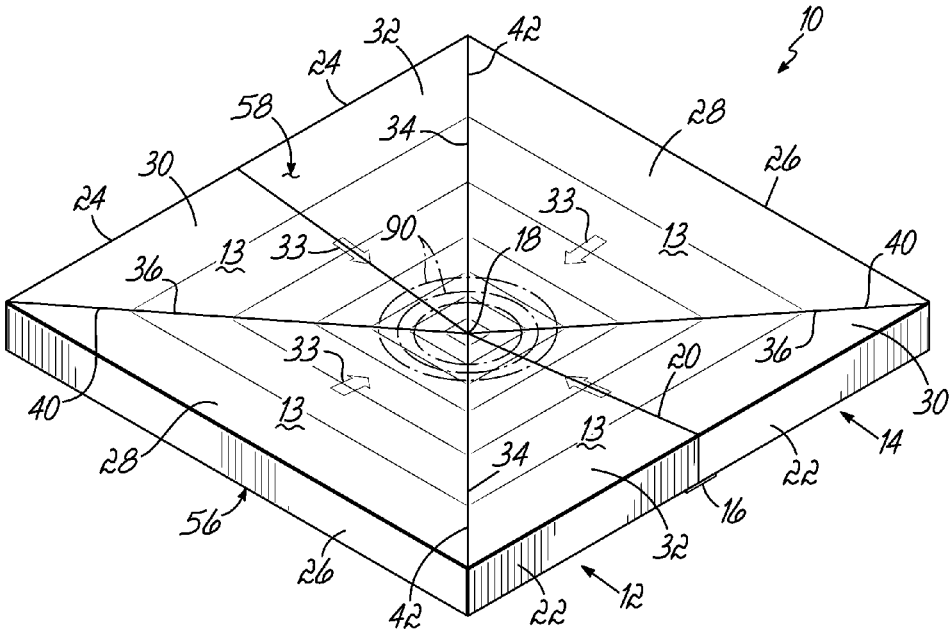
FIG. 1 is a perspective view of the present invention.
Figure 2A:
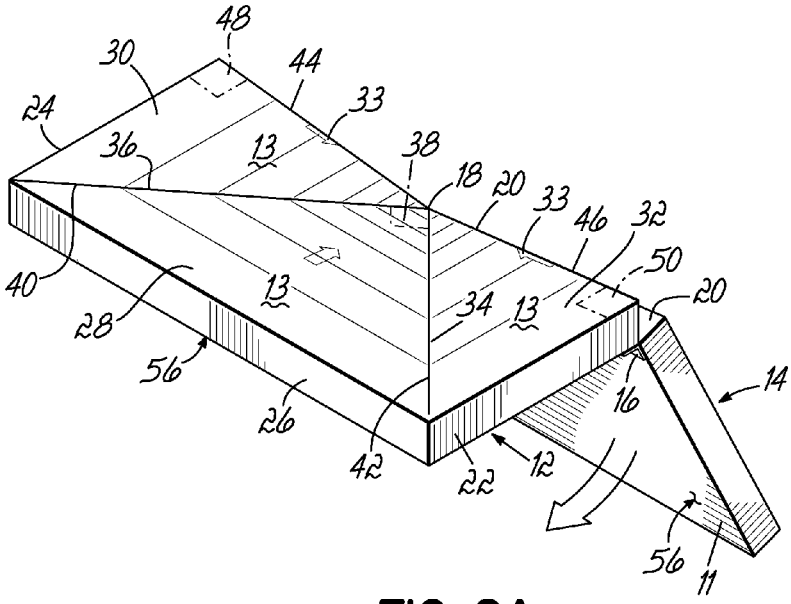
FIG. 2A is a sump shown in FIG. 1 in a partially folded position.
Figure 2B:
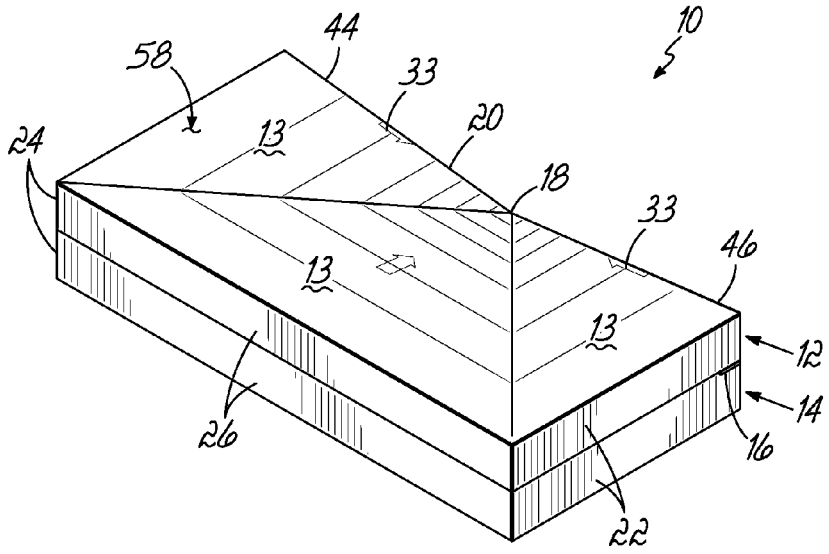
FIG. 2B is the sump shown in FIG. 2A in a totally folded position.

As shown in FIGS. 1-2B, the present invention is a preformed sump 10 which includes a first side 12 and a mirror image second side 14 which are connected together by a hinge 16. The bottom surface 11 of the sump is flat, whereas the top surface 13 is sloped as explained below.

The first side 12 and the second side 14, being mirror images of each other, will be described together with like numbers used for like elements, when appropriate.

Each side 12 and 14 includes a central point 18 which is the lowest point on each side and forms the drainage point for the sump which eventually will be cut open to provide access to a drain. Each side 12 and 14 further includes a first long sloped edge 20 which slopes downwardly from either side to the central point 18 from first and second opposed non-sloped short edges 22 and 24. Opposite the long sloped edge 20 is a long non-sloped edge 26. The long edges will generally be eight feet in length and twice the length of the short edges 22 and 24.

Each side 12 and 14 is formed from three panels, a central panel 28, first side panel 30, and second side panel 32. Note that panels 32 and 30 are reversed on sides 12 and 14. The slope for all of these panels is indicated by arrows 33 whose points indicate the downward slope direction of the panel.

Figure 3A:
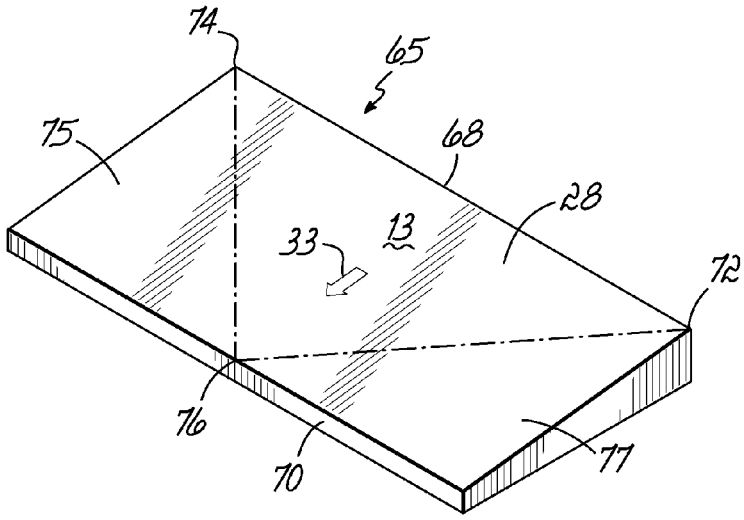
FIG. 3A is a perspective view of a panel used to form the individual panels that comprise the sump.
Figure 3B:
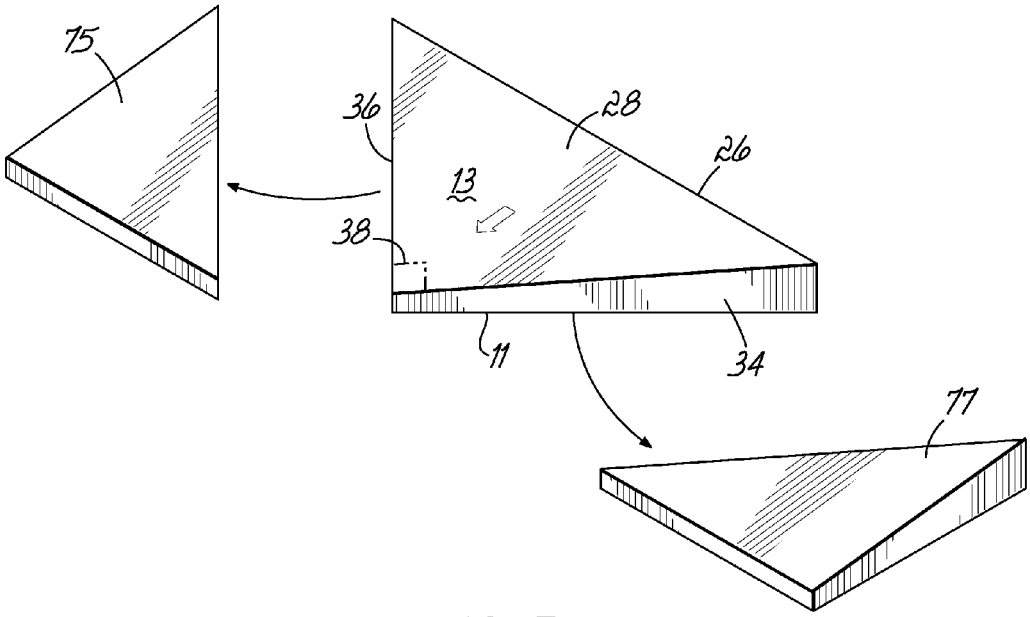
FIG. 3B is an assembly drawing demonstrating the formation of a central panel.
Figure 3C:
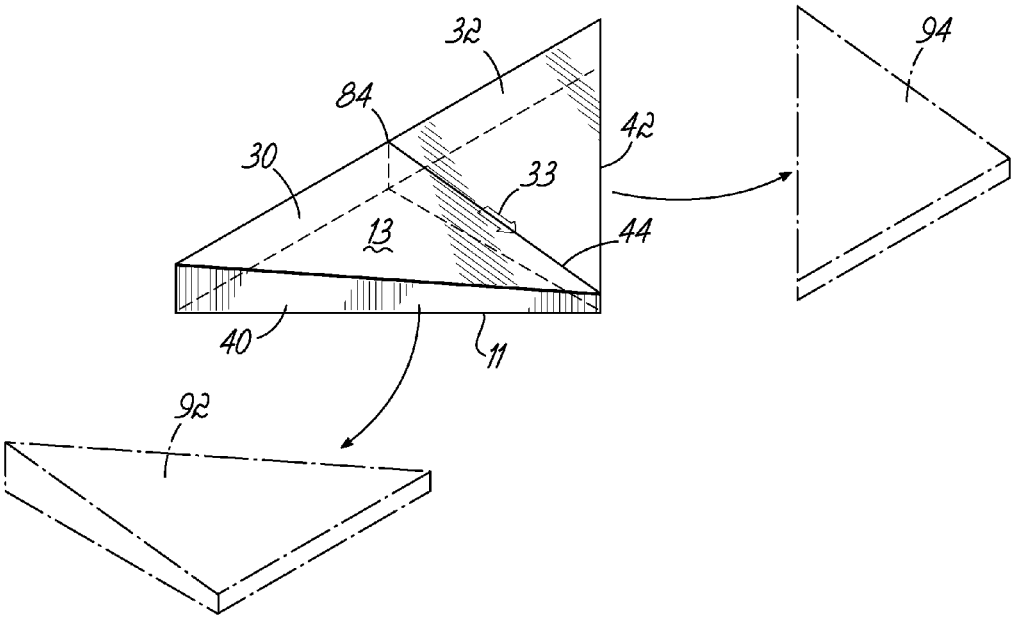
FIG. 3C is an assembly drawing showing the formation of the side panels.
Figure 3D:
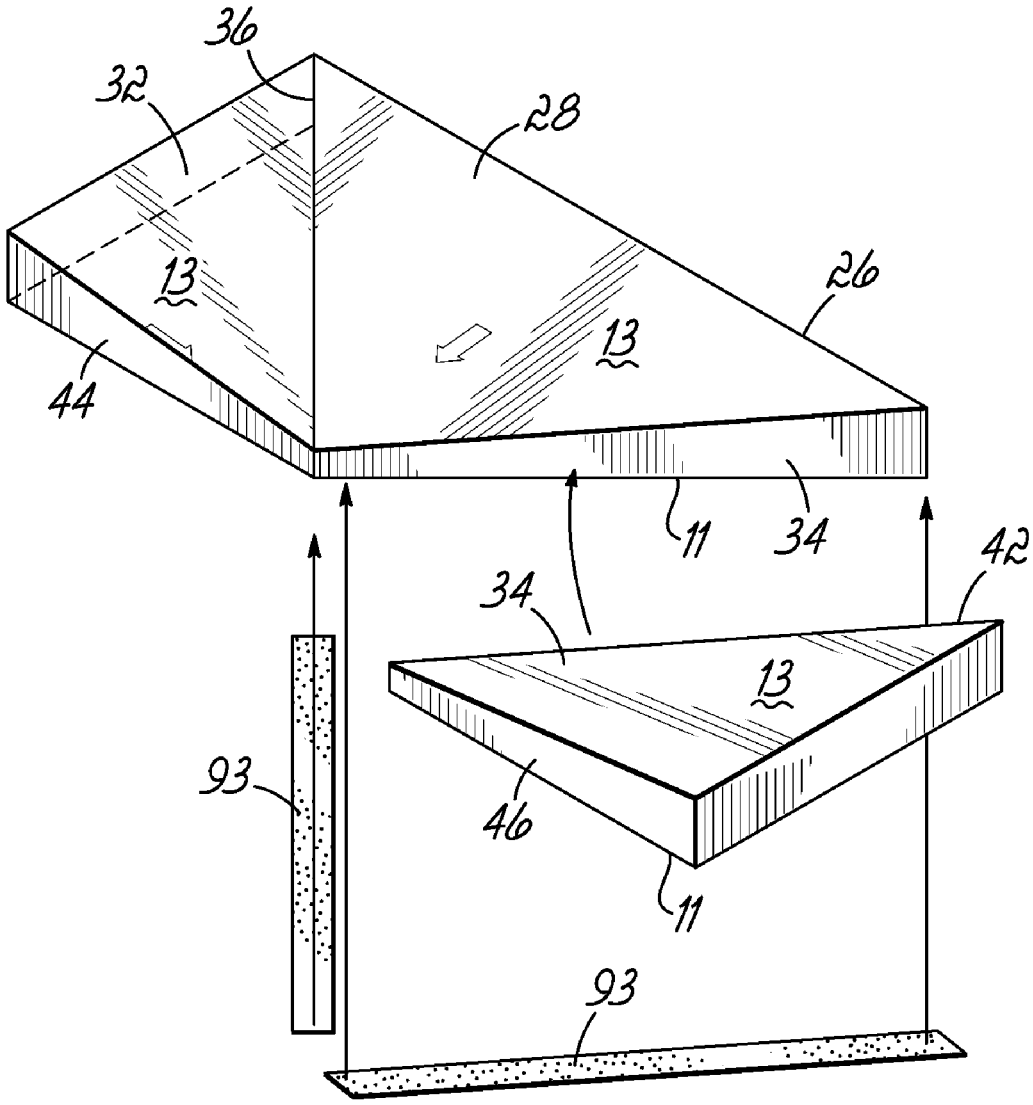
FIGS. 3D-3F show the assembly of the sump.
Figure 3E:
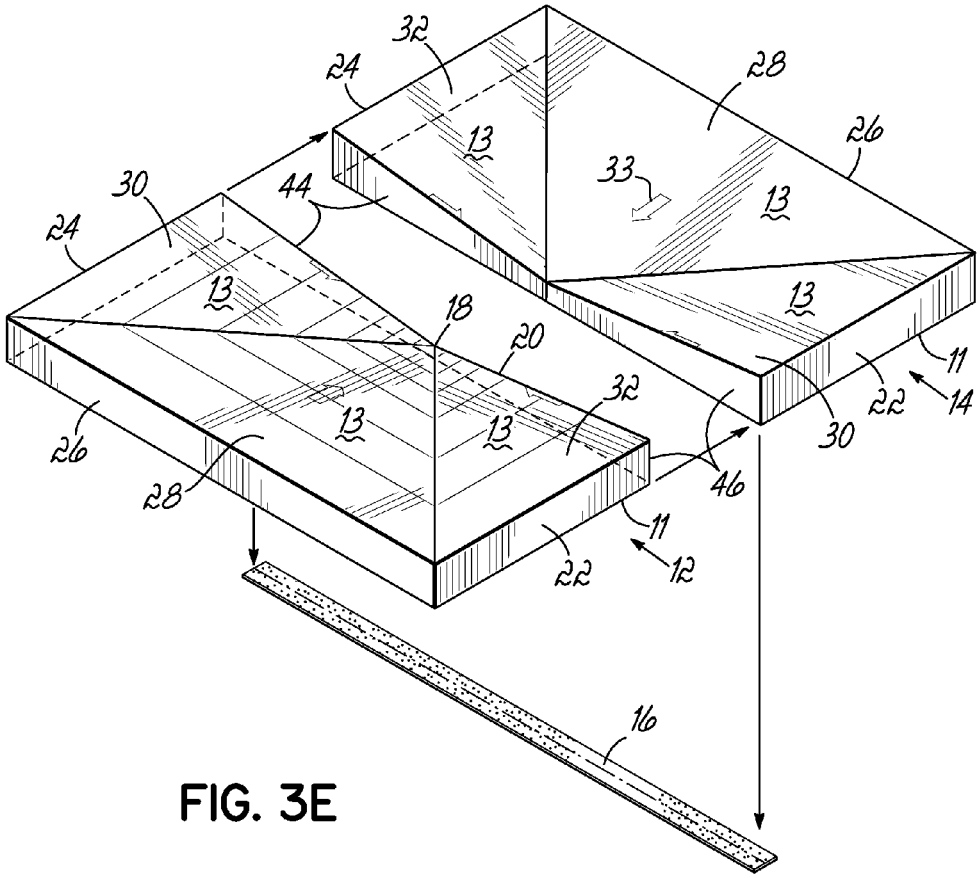
Figure 3F:
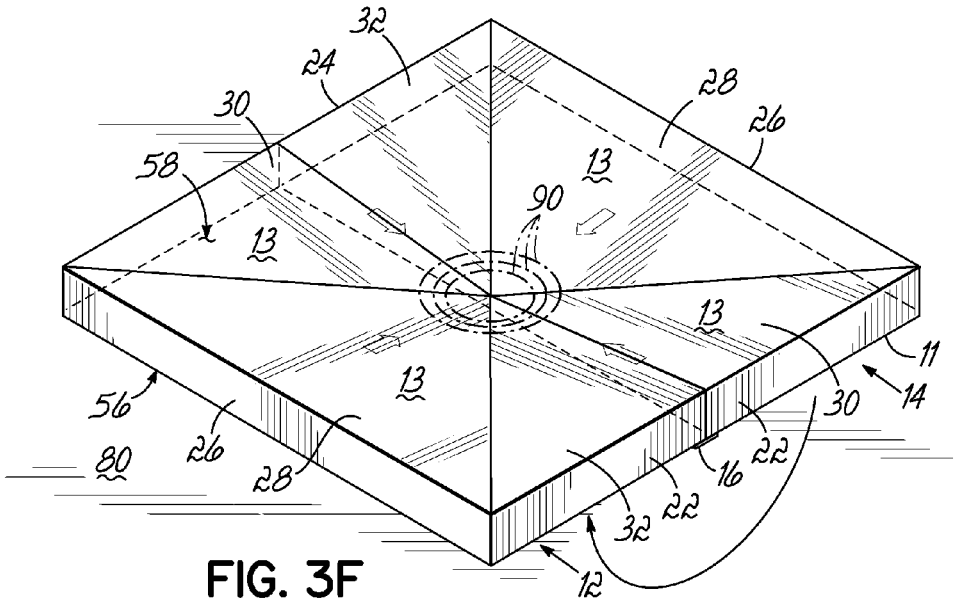

The central panel 28 is a right angle isosceles triangle wherein the long non-sloped edge 26 forms the hypotenuse, and sloped edges 34 and 36 form the first and second legs respectively. The right angle 38 (shown in dashed lines) is formed at the central point 18. Panels 30 and 32 likewise are right isosceles triangles. Each has a hypotenuse 40 and 42 which extend along legs 34 and 36 of the central panel 28. Further, each of these panels 30 and 32, include a sloping leg 44 and 46, which extend from the non-sloped edges 22 and 24 towards the central point 18. The remaining leg is formed from the non-sloped edges 22 and 24. Each panel has a 90 degree angle 48 and 50, respectively. As best shown in FIGS. 3D-3F, the central panel 28 and side panels 30 and 32 are all held together with a 4-inch fleece backed adhesive tape, such a butyl tape, 52,54, which is located on the bottom surface 11 of the sump 10.

The two sides 12 and 14 are held together by hinge 16, which is a generally 6-inch wide fleece backed butyl tape which is attached to the bottom surface 56 of the first and second sides 12 and 14. Tape/hinge 16 is wide enough to contact all of the panels, holding them together hinged along their long sloped edge 20 with the central points 18 from each side adjacent each other.

The individual panels 28, 30 and 32 of the sump are formed from a foamed board 65 which has a slope, i.e., its thickness decreases from one edge to an opposite edge. The top side 13 is sloped, whereas the bottom side 11 is flat. The foam board 65 has a long dimension and a short dimension. Generally it will be 4 feet by 8 feet, with the board sloping from the first long edge, or the thick long edge, 68, to the second long edge, or thin long edge, 70. As shown in FIGS. 3A and 3B, the central panel 28 is formed from such a board 65 by simply cutting from the corners 72 and 74 on the thick edge 68 to a center point 76 on a thin edge. This will form the right isosceles triangle which is the central panel 28. Portions 75 and 77 are discarded.

As shown in FIG. 3D, the side panels 30 and 32 are mirror images of each other and can be formed in one of two manners. If formed from a 4×8 sheet, they are formed by simply forming a panel identical to the central panel 28 and cutting at a 90° angle from the midpoint 84 of the thick long edge 68 through the panel, forming panels 30 and 32 respectively. Sections 92 and 94, formed when the central panel is formed, are discarded and can be recycled. This is repeated to form two sets of side panels 30 and 32.

Side panels 30 and 32 can also be formed from a 4×4 sloped panel and cutting diagonally from a left thick corner to a right thin corner for panel 30, and from a right thick corner to a left thin corner for panel 32.

Each side 12 and 14 is formed by taping the side panels 30,32 to the central panel 28. The tape 52,54 is applied to the bottom surface 11. Panels 30 and 32 are reversed on the sides 10 and 12. As shown in FIG. 3E, the two sides 10 and 12 are then taped together from the bottom surface by adhesive tape 16. This holds the panels tightly together and allows the sump to fold to an 8×4 configuration.

In use on a roof, the folded sump 10, as shown in FIG. 2B, is placed on the roof surface 80. While still folded, an opening is cut at the central point 18 to allow for a drain. The size of the opening is determined by the size of the drain. The sump 10 includes a series of circles 90 (a semicircle on each side) which indicate different sizes to allow one to cut the appropriate sized opening to fit the drain pipe. The sump is then unfolded at hinge 16 (see FIG. 3F) and positioned over the drain pipe (not shown). Foam board insulation is positioned on the roof surrounding the sump. This can either be sloped insulation or flat insulation. A roof membrane (not shown) is located over the insulation and the roof drain completed as per standard specifications.

Thus, as shown the sump 10 of the present invention facilitates installation of a flat roof, significantly reducing installation time. Also, it requires relatively little experience to properly install the sump. This will reduce the time and cost of installing a flat membrane roof and ensure proper installation.

This has been a description of the present invention along with the preferred method of practicing the present invention. However, the invention itself should only be defined by the appended claims.

What is claimed is:

1. A hinged drain sump comprising a first panel and a mirror image second panel, said first and second panels each sloped along three planes to a central point, said first and second panels hinged together along a sloped elongated side with said central points of each panel adjacent each other;

and each side having three separate right isosceles triangle panels including a central panel comprising a right isosceles triangle having a central panel hypotenuse with a constant thickness and first and second opposed central panel legs each having a thickness which decreases from said central panel hypotenuse to a 90 degree angle of said central panel located at said central point;

a first side panel comprising a right isosceles triangle having a first constant thickness first panel leg and a second decreasing thickness first panel leg and a first panel hypotenuse having a decreasing thickness, said first panel bonded along said first panel hypotenuse to said central panel;

a second side panel which is a mirror image of said first side panel said second panel having a hypotenuse bonded to said second central panel leg wherein said sump includes a folded position which is half the size of an unfolded position and can be unfolded at a job side and positioned over a drain.

2. The sump claimed in claim 1 wherein all of said panels comprise a rigid foam board.

3. The sump claimed in claim 2 wherein said panels are formed from polyisocyanate.

4. The sump claimed in claim 1 wherein said sump is a square when unfolded.

5. The sump claimed in claim 1 wherein said central point includes indicia including sizes to cut for a drain.

6. The sump claimed in claim 1 wherein said first side is connected to said second side by a flexible tape fixed to bottom surfaces of said first and second sides and said central and side panels and fixed to each other by tape on bottom surfaces of said central and side panels.

* * * * *